United States Patent [19]

Selbach et al.

[11] Patent Number: 4,682,361

[45] Date of Patent: Jul. 21, 1987

[54] METHOD OF RECOGNIZING SPEECH PAUSES

[75] Inventors: Bernd Selbach, Eckental; Peter Vary, Herzogenaurach-Niederndorf, both of Fed. Rep. of Germany

[73] Assignee: U.S. Philips Corporation, New York, N.Y.

[21] Appl. No.: 552,994

[22] Filed: Nov. 17, 1983

[30] Foreign Application Priority Data

Nov. 23, 1982 [DE] Fed. Rep. of Germany ..... 3243232

[51] Int. Cl.[4] ..... G10L 5/00

[52] U.S. Cl. ..... 381/46

[58] Field of Search ..... 381/46

[56] References Cited

U.S. PATENT DOCUMENTS 3,507,999 4/1970 Schroeder ..... 381/46
4,052,568 10/1977 Jankowski ..... 381/46
4,357,491 11/1982 Daaboil et al. ..... 381/46
4,535,473 8/1985 Sakata ..... 381/46
4,597,098 6/1986 Noso et al. ..... 381/46

*Primary Examiner*—E. S. Matt Kemeny
*Attorney, Agent, or Firm*—Anne E. Barschall

[57] ABSTRACT

A method of recognizing speech pauses in a speech signal even when the signal is disturbed by a slowly varying noise signal superposed thereon. Mean values which are an approximate measure of the average power of successive sections of the disturbed signal are determined from the short-time Fourier coefficients of the disturbed speech signal. The sequential short-time mean values are then smoothed by a linear digital filter or a median filter. An estimate of the noise signal power averaged over a few seconds is also recovered from the sequence of short-time mean values. A speech pause is signified when the smoothed short-time mean value (output of GL) more than once falls to a threshold which is proportional to the estimated noise power (output of PA).

8 Claims, 2 Drawing Figures a b c

METHOD OF RECOGNIZING SPEECH PAUSES

BACKGROUND OF THE INVENTION

1. Field of the Invention

The invention relates to a method of recognizing speech pauses from the short-time spectrum of a speech signal which may have noise signals superposed on it.

2. Description of the Related Art

Methods of this type are, for example, the prerequisite for the suppression of noise signals when telephone calls are made from an environment with acoustic disturbances. During the speech pauses characteristic parameters of the noise signal are measured and employed, before transmission, to filter out the noise substantially wholly from the signal to be transmitted, using adaptive filters.

German Patent 24 55 477 and the corresponding British Pat. No. 1,515,937, published June 28, 1978, disclose in, column 10 an analog technique for recognition of speech pauses, which is based on the following method: the speech signal is divided into sections of equal lengths and a voltage value is obtained for each section by means of rectification and deriving the mean value, this voltage value being proportional to the average sound volume of the section. Finally, by deriving the mean value of several speech sections a further voltage value is determined, which is proportional to the average loudness of the conversation. By comparing these two mean values it is determined whether a particular section is associated with a speech pause or not.

In the said method of speech pause recognition no account is inter alia taken of the fact that, for example, during continuing speech there are unvoiced intervals which result in an almost total power reduction in the speech signal and the relevant speech sections are therefore erroneously recognized as speech pauses. Such faulty decisions occur in the prior art method more frequently as the extent to which noise signals are superposed on the speech signal increases.

SUMMARY OF THE INVENTION

It is therefore an object of the invention, to provide a method as described in the opening paragraph, in which faulty decisions as defined above are avoided. The method may be performed with digital means, and achieves speech pause recognition even when the average noise power changes only slowly.

The method according to the invention can be used with particular advantage when - as in the application mentioned in the opening paragraph - an arrangement is used for noise suppression, based on a short-time Fourier analysis of the disturbed speech signal. It is then not necessary to separately determine the Fourier coefficients in order to carry out the method according to the invention.

BRIEF DESCRIPTION OF THE DRAWINGS

The invention will now be further described by way of example with reference to the accompanying drawings.

In these drawings.

DESCRIPTION OF THE PREFERRED EMBODIMENTS

Figure 1:
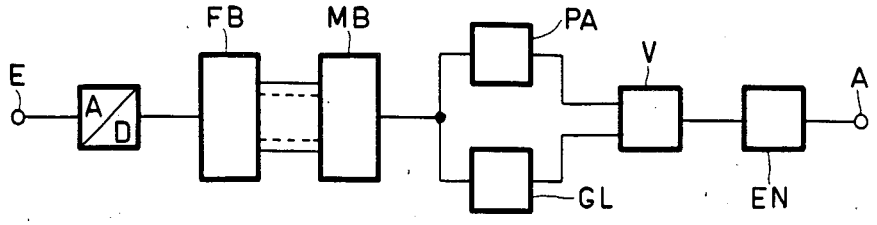
FIG. 1 is a block diagram to explain the method according to the invention.

In the block diagram shown in FIG. 1 the disturbed speech signal is applied to an input terminal E. An analog-to-digital converter A/D produces from the analog input signal a sequence of digitized sampling values. The sampling values are applied to a filter bank FB which determines at each instant $\tau(n)$ of a clock-designated central clock hereinafter a set W(n) of M Fourier coefficients Y1(n), Y2(n) . . . YM(n) of the short-time spectrum.

The method in accordance with the invention utilizes only Fourier coefficients whose associated frequencies are located in a frequency between 0 Hz and approximately 3000 Hz, as this range is the range of highest spectral energy density of speech. As a result, speech pause recognition is improved when the spectrum of the noise signal covers a wider frequency range.

From the set W(n) of the Fourier coefficients Y1(n), Y2(n) . . . YM(n), and the preceding sets of Fourier coefficients, a mean-value processor MB determines a short-time mean value G(n), which is approximately a measure of the average power of the disturbed speech signal, the period of time in over which the mean value is determined being of the order of magnitude of 100 ms. The exact averaging procedure will be described in greater detail hereinafter. A unit GL smooths the sequence of short-time mean values G(n). This is to ensure that during the ultimate determination of whether there is a brief speech pause, almost total power reductions in the speech signal caused by unvoiced intervals during continuing speech are not erroneously recognized as pauses. A unit PA in FIG. 1 determines an estimate P(n) of the noise power, that is to say the power of the noise signals, and also sets a first threshold S depending thereon. More details of how the estimate is determined will also be given hereinafter. If the sequence GG(n) of the smoothed short-time mean values is below the threshold S, then a comparator V applies a speech pause indicating signal to a unit EN.

If the unit EN has received successively, for example, 25 times, a signal from the comparator V, then it indicates the presence of a speech pause by producing a signal at its output terminal A.

The filter bank FB determines, for example every 4 ms, a set W(n) of M=30 Fourier coefficients of the short-time spectrum. That is, the period of the central clock amounts to 4 ms. Determining the short-time mean values G(n) at the clock instants $\tau(n)$ requires both an averaging of all the Fourier coefficients Y1(n) . . . YM(n) at a particular instant $\tau(n)$ and an averaging of the coefficients at different clock instants. To describe the averaging procedure in the form of a formula, an auxiliary quantity H(n) is introduced which is obtained by averaging only those Fourier coefficients which are determined at the instant $\tau(n)$ that is to say, $$H(n) = \frac{1}{M} \sum_{i=l}^{M} |Yi(n)| \text{ or } H(n) = \frac{1}{M} \sum_{i=l}^{M} |Yi(n)|^2$$

according to whether one wants to employ the arithmetic mean of the amounts or of the squares of the amounts. As using the amounts requires less components, the first possibility will generally be preferred for determining the auxiliary quantity H(n).

According to the invention, the short-time mean value G(n) is now obtained be averaging the quantity H(n) at different clock instants:

$$G(n) = \frac{1}{N} \sum_{k=o}^{N=l} H(n-k)$$

The number N of the considered instants is 25.

The recursive method of determining the mean, $$G(n)=(1-\delta)G(n-1)+\delta H(n)$$

is more advantageous, since this requires less components. In that method the short-time mean value G(n) at the clock instant $\tau$(n) is obtained as the linear combination of the short-time mean value G(n−1) at the clock instant $\tau$(n−1) and the auxiliary quantity H(n). A typical value of the constant $\delta$ is 0.1.

From the sequence of short-time mean values G(n) two further quantities, namely a smoothed short-time mean value GG(n) and an estimate P(n) for the average noise power are obtained in accordance with the invention at each clock instant $\tau$(n). The smoothed value GG(n) can be recovered with the aid of, for example, a linear digital filter, which, to derive as an output the quantity GG(n), takes the weighted average of three consecutive short-time mean values G(n), G(n−1) and G(n−2) weighting factors (filter coefficients) $\frac{1}{4}$, $\frac{1}{2}$ and $\frac{1}{4}$ have been found to be satisfactory.

A further possibility is filtering by means of a median filter. Then, for example, five consecutive values G(n) . . . G(n−4) are arranged according to value and thereafter the third value is read as the output value GG(n) of the filter.

The continuous determination of the noise power estimate P(n) can also be effected in two different manners. In one procedure a longer speech pause is first determined and then the value of P(n) is updated with a short-time mean value G(n), which is located in this speech pause. Because of the continuous updating of the estimate P(n), speech pause recognition is still possible in the method according to the invention even when the power level changes slowly.

A longer pause is signified when the inequality $$|G(n)-G(n-1)|<D=YG(n)$$

is satisfied K times consecutively. That is, the difference between two consecutive short-time mean values G(n) and G(n−1)must, K times in succession, fall below a limit D. The limit D is chosen proportionally to the short-time mean value G(n), so that the same results are obtained even, when, for example, the level of all the signals are doubled.

The values K=30 and Y=1.1 were found to be advantageous. If G(n) is, for example, the thirtieth value, for which the above-mentioned inequation is satisfied, then the estimate P(n) is updated in accordance with the equation $$P(n)=(1-\alpha)P(n-1)+\alpha G(n)$$

That is to say, the new estimate P(n) is a linear combination of the old estimate P(n−1) and the previously determined short-time mean value G(n) which is contained in a longer pause. For the constant $\alpha$ a value of 0.5 is advantageous. If no longer pause is present, then the old estimate is retained, that is to say P(n)=P(n−1) is set.

A different procedure is used to obtain the best possible estimate P(n) for a slowly varying noise power. This consists of increasing at each clock instant $\tau$(n) the estimate P(n−1) already present, by a fixed amount c, when the estimate P(n−1) is less than the short-time mean value G(n). Each time that the inequality P(n—1)<G(n) is satisfied, the value of P(n) is set at $$P(n)=P(n-1)+c.$$

The constant c can be chosen such that at an unimpeded increase in the estimate will reach a boundary value in one or two seconds. If on the other hand the estimate P(n−1) already present is higher than the instantaneous short-time mean value G(n), then the new estimate P(n) is reduced with respect to the estimate present, more specifically in accordance with the equation $$P(n)=(1-\beta)P(n-1)+\beta G(n),$$

which represents the new estimate as a linear combination of the preceding estimate and the instantaneous short-time mean value G(n). A reduction in the estimate can be recognized most distinctly when a value one is chosen for the constant $\beta$. Then, namely, it is obtained that P(n)=G(n)<P(n−1). However, values around 0.5 have been found to be more advantageous for the constant $\beta$.

The threshold S, which is used to decide whether there is a pause or not, is higher than the estimate P(n). Typical for the relationship between the threshold S and the estimate P(n) is the equation S=1.15P(n), when for the determination of the short-time mean values the amounts of the Fourier coefficients are used. When the squares of the amount are used the relationship is typically S=1.3P(n).

Figure 2:
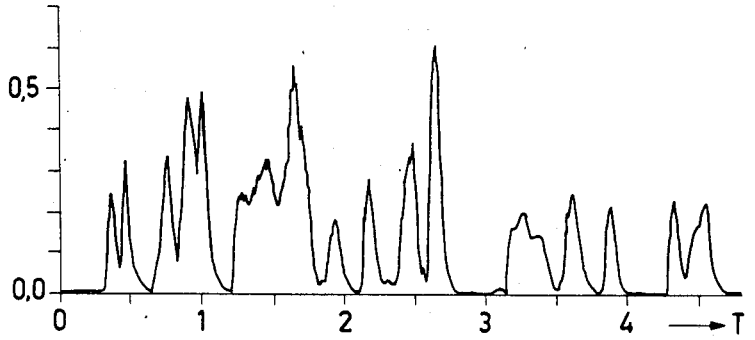
FIG. 2 shows various waveforms involved in the method according to the invention.
Figure 2:
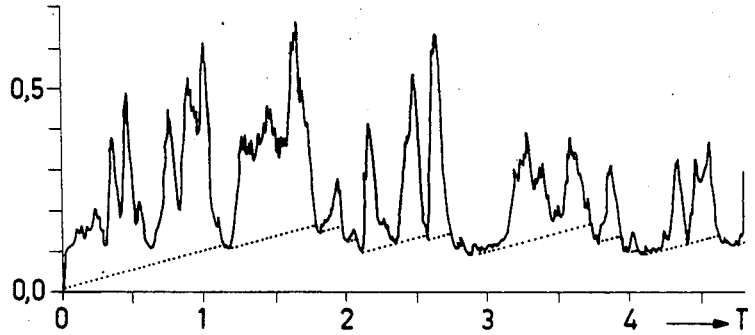
Figure 2:
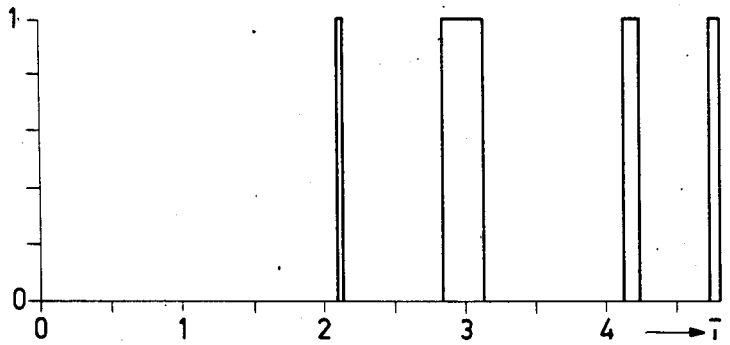

Diagram (a) of FIG. 2 shows an example of the sequence of smoothed (and standardized to one) short-time mean values GG(1), GG(2) . . . of an undisturbed speech signal. The sequence of GG(n) is plotted versus time. The time interval considered has a length of approximately 5 seconds. The position of the speech pauses can be recognized in that there the quantities GG(n) assume the valaue 0.

In diagram (b) that sequence of GG(n) is shown which was recovered from a disturbed speech signal. The speech signals on which the diagrams (a) and (b) are based are identical. The dotted curve in diagram (b) is the sequence of the noise power estimates P(n), which were determined in accordance with the second of the above described possibilities. The result of the speech pause determination is shown in diagram (c). The presence of a speech pause is expressed in this diagram in that the ordinate assumes the value 1 during the speech pause and the value 0 outside the speech pause.

What is claimed is:

1. A method of detecting speech pauses from the short-time spectrum of a speech signal which may be disturbed by noise signals superposed on it, characterized in that at each clock instant $\tau$(n) of a central clock (a) a set W(n) consisting of M Fourier coefficients Y1(n), Y2(n) . . . YM(n) of the short-time spectrum of the disturbed speech signal is determined from digital samples of such signal, (b) from the M Fourier coefficients of the set W(n), and the NM Fourier coefficients of all of the sets W(n−1), W(n−2) . . . W(n−N) of such coefficients at N prior clock instants, the short-time mean value G(n) of all such Fourier coefficients is determined, (c) the noise signal power P(n) is estimated as a function of an estimate P(n−1) thereof at the preceding clock instant and of the short-time mean value G(n), (d) a smoothed short-time value GG(n) is determined as a function of the short-time mean value G(n) at clock instant $\tau$(n) and the short-time mean values at a plurality of preceding clock instants, (e) if the smoothed short-time mean value GG(n) several times in succession falls below a first threshold (S) proportional to the estimated noise signal power P(n), a signal is produced indicating the presence of a speech pause.

2. A method as claimed in claim 1, characterized in that the short-term mean value G(n) is determined as the arithmetic mean of the values of the Fourier coefficients.

3. A method as claimed in claim 1, characterized in that the noise signal power estimate P(n) is determined in accordance with the equation $P(n)=(1-\alpha)P(n-1)+\alpha G(n)$, where $\alpha$ is a second constant, when the value of the difference between the short-time mean values G(n)−G(n−1) falls below a second threshold (D) and this has occurred consecutively for a plurality of preceding clock instants, and until that occurs the estimate P(n) is continued equal to the preceding estimate P(n−1).

4. A method as claimed in claim 1, characterized in that the estimate P(n) is determined in accordance with the equation P(n)=P(n−1)+c where c is a third constant, when the inequality P(n−1)<G(n) has been satisfied, and until that occurs the estimate P(n) is determined in accordance with the equation $P(n)=(1-\beta)P(n-1)+\beta G(n)$, where $\beta$ is a fourth constant.

5. A method as claimed in claim 1, characterized in that the short-time mean value G(n) is determined recursively in accordance with the equation $G(n)=(1-\delta)G(n-1)+\delta H(n)$, where H(n) represents an average of all the Fourier coefficients at the instant $\tau$(n) and $\delta$ is a first constant.

6. A method as claimed in claim 1, characterized in that the first threshold (S) is proportional to the estimate P(n).

7. A method as claimed in claim 1, characterized in that the smoothed short-time mean value GG(n) is recovered from the three short-time mean values G(n), G(n−1) and G(n−2) in accordance with the formula $$GG(n) = \sum_{i=o}^{2} c_i G(n-i)$$

where the constant $c_0$, $c_1$, $c_2$ all exceed or are equal to 0 and their sum has the value 1.

8. A method as claimed in claim 3, characterized in that the second threshold (D) is proportional to the short-time mean value G(n).

* * * * *

UNITED STATES PATENT AND TRADEMARK OFFICE

CERTIFICATE OF CORRECTION

PATENT NO. : 4,682,361

DATED : July 21, 1987

INVENTOR(S) : Bernd Selbach et al

It is certified that error appears in the above-identified patent and that said Letters Patent is hereby corrected as shown below:

IN THE CLAIMS

Col. 5, Claim 1, line 19 after "time" insert --mean--

Signed and Sealed this

First Day of January, 1991

*Attest:*

*Attesting Officer*

HARRY F. MANBECK, JR.

*Commissioner of Patents and Trademarks*